United States Patent [19]

Eyermann et al.

[11] 4,198,945

[45] Apr. 22, 1980

[54] INTERNAL COMBUSTION ENGINE STARTER DISCONNECT SYSTEM

[75] Inventors: Manfred Eyermann, Illingen; Wolfgang Pfeifer, Schwieberdingen, both of Fed. Rep. of Germany

[73] Assignee: Robert Bosch GmbH, Stuttgart, Fed. Rep. of Germany

[21] Appl. No.: 865,580

[22] Filed: Dec. 29, 1977

[30] Foreign Application Priority Data

Jan. 12, 1977 [DE] Fed. Rep. of Germany ..... 2700982

[51] Int. Cl.[2] ..... F02N 17/00; F02N 11/08

[52] U.S. Cl. ..... 123/179 B; 123/179 BG; 290/37 A; 290/DIG. 4

[58] Field of Search ..... 123/179 B, 179 BG; 290/37 A, DIG. 4

[56] References Cited

U.S. PATENT DOCUMENTS

| | | | |
|---|---|---|---|
| 3,712,283 | 1/1973 | Kiesr et al. | 123/179 B |
| 3,885,543 | 5/1975 | Swartz | 123/179 B |

FOREIGN PATENT DOCUMENTS

| | | | |
|---|---|---|---|
| 2254412 | 5/1974 | Fed. Rep. of Germany | 123/179 B |
| 2620988 | 11/1976 | Fed. Rep. of Germany | 123/179 B |
| 515498 | 12/1939 | United Kingdom | 290/DIG. 4 |
| 915955 | 1/1963 | United Kingdom | 290/37 A |

*Primary Examiner*—Charles J. Myhre
*Assistant Examiner*—P. S. Lall
*Attorney, Agent, or Firm*—Frishauf, Holtz, Goodman & Woodward

[57] ABSTRACT

When the starter motor which can be coupled to an internal combustion engine, typically an automotive engine, has accomplished its function and the automotive engine started, it is disconnected by a switch which is controlled from a sensing circuit connected to the energization circuit of the starter and responsive to a-c components. The system operates on the basis that, before the engine has started, the sequential compression and decompression in the cylinders of the internal combustion engine will result in alternating components which are superimposed or modulated on the energy flow to the starter motor. When the internal combustion (IC) engine has started, the undulations and variations in energy supplied to the motor will terminate. The system is sensitive to such termination and disconnects the starter motor at that time.

15 Claims, 2 Drawing Figures

INTERNAL COMBUSTION ENGINE STARTER DISCONNECT SYSTEM

Figure 1:
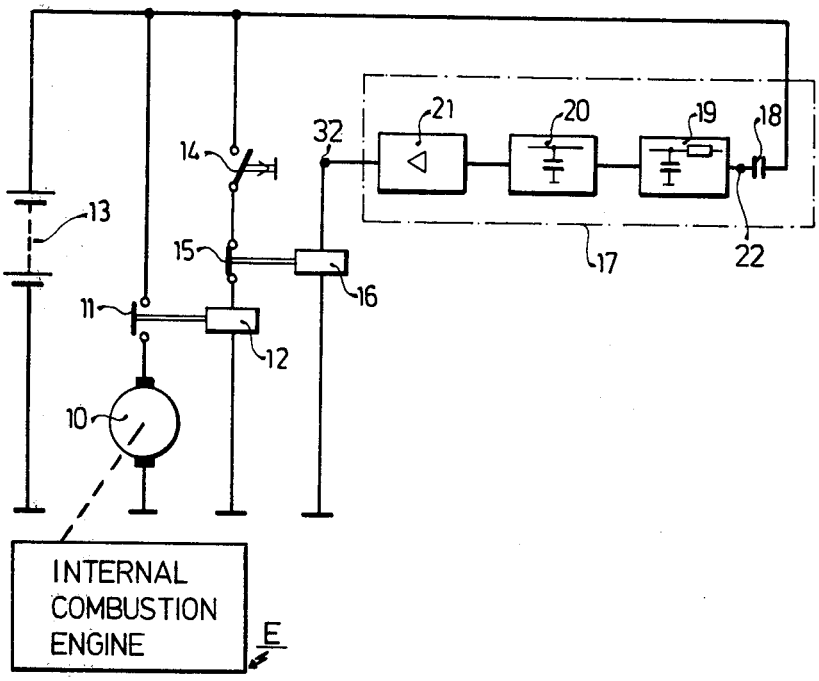

The present invention relates to a starter motor control system for use in combination with an internal combustion (IC) engine, and more particularly to a starting motor system for an automotive-type internal combustion engine supplied from an on-board self-contained vehicle battery.

BACKGROUND AND PRIOR ART

Electric starter motors to start IC engines usually have a manually controllable switch which controls a relay connecting the starter motor to the battery of a vehicle. A protective circuit or protective switch can be provided which deenergizes the starter motor when the speed of the IC engine exceeds that of the starter motor, that is, when the IC engine has started. Various systems to interrupt current to the starter motor have been proposed. Current through the starter motor, initially, rises rapidly upon turning the IC engine and then drops gradually. It has been proposed to automatically interrupt power to the starter motor by measuring the power supplied thereto and, when it has dropped below a predetermined value, to disconnect the starter motor since this current drop is taken as an indication that the IC engine has started. Such systems are not entirely reliable since, under some conditions and particularly when starting occurs in the winter time, the direct control of the starter motor relay may cause triggering of the disconnect system since the starter motor rises from zero to a very high value very rapidly. This will then result in disconnection of the starter motor before it even had the opportunity to start the IC engine.

THE INVENTION

It is an object to provide a simple and reliable system which will disconnect the starter motor when the IC engine speed exceeds that of the starter motor or, in other words, when the IC engine has started.

Briefly, the energization circuit has a sensing element, typically a capacitor, connected thereto which senses pulsations or undulations of power being supplied to the motor. Usually, voltage drop across a supply battery or current flow through the motor can be sensed by the energization circuit, the undulations or a-c component of current flow being due to the sequential compression and decompression of gases in the cylinders of the IC engine when the starter motor is energized, but before the IC engine has started. The pulsation sensing means are connected to an evaluation or analyzing circuit which is sensitive to characteristics of the pulsations and provides a disconnect signal to the disconnect or overrun switch when the pulsations essentially disappear. The evaluation circuit may include an integrator, preferably connected through a filter, to filter out short-time noise signals and high-frequency variations, for example due to brush interruptions and brush fire, the integrator integrating a-c pulses applied thereto through the filter by a coupling capacitor. Alternatively, the pulsation evaluation circuit may include a circuit which determines the change of instantaneous power being supplied from an average or mean value and, when the change becomes minor, or drops below a predetermined level, to then provide a disconnect signal to the starter relay.

The system is reliable and operates trouble-free regardless of weather and temperature conditions. It can be constructed simply and with a minimum of components, all of which are readily available standard items in the electrical field, and is particularly adapted to the rough and unusually severe operating environments in which automotive vehicles may be used.

Figure 2:
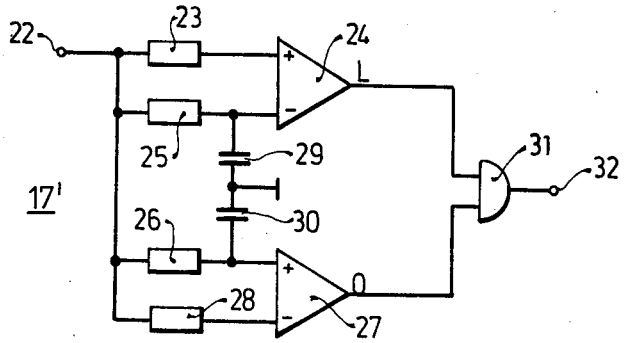

Drawings, illustrating an example:

FIG. 1 is a general schematic diagram of a system in accordance with the invention; and FIG. 2 is a fragmentary diagram illustrating another embodiment of an evaluation circuit, constructed as a voltage change discriminator or analysis circuit.

An internal combustion engine E (FIG. 1) can be selectively coupled to a starter motor 10, as schematically indicated by the broken line connection. The starter motor 10 is energized from a battery 13 by means of a starter switch 11, 12, the starter switch having contacts 11 and being controlled by a relay 12. The relay 12 can be manually energized by means of the manually operable starter switch 14. Switch contacts 15 of an overrun control relay 15, 16 are serially connected between the manual switch 14 and the relay coil 12. Switch contacts 15 are controlled by relay coil 16 which, in turn, is energized when the control circuit 17 provides an output indicating that the motor 10 is at a the speed at which the speed of engine E will overrun the motor 10. This, then, will open the circuit connection through coil 12 and break the contacts 11, thus disconnecting the starter motor 10.

The control circuit 17 includes an input capacitor 18, forming an isolating and coupling capacitor. Capacitor 18 is connected to a filter 19, an integrator 20, and an amplifier 21.

Operation: Upon starting of an IC engine, the sequential compression and decompression in the cylinders thereof will result in undulations or pulsations, that is, an a-c power component which are superimposed or modulated on the average, d-c power supplied to the motor 10 from the battery 13. When the IC engine is running under its own power, then these undulations or pulsations are essentially eliminated. The control circuit 17 evaluates the presence of such undulations or pulsations and, upon their discontinuance, controls the protecting switch 16 to open terminals 15 and thereby disconnect motor 10.

The undulations occurring upon starting of the IC engine and the power supply, that is, voltage or current undulations, are filtered by the filter 19. The d-c component is blocked by capacitor 18. Filter 19 removes the higher frequencies which occur, for example, due to poor contacts of the carbon brushes of motor 10, or other noise pulses. The a-c voltage portion, or the a-c component of the overall voltage or current supplied by the battery is summed by the integrator 20. When a certain threshold level is reached, as amplified by amplifier 21, switch 16 is controlled to become energized to thereby disconnect motor 10.

Variations in voltage, and/or current flow through the motor can be directly sensed. A current change discriminating circuit can be directly connected to the isolating capacitor 18. Voltage or current changes are then analyzed or evaluated by the discriminating circuit and directly controlled amplifier 21 or, alternatively, the switch 16 which disconnects the motor as above described.

The circuit 17' of FIG. 2 is connected between terminals 22, 32 (FIG. 1). The input terminal 22 is connected to four coupling resistors 23, 25, 26, 28. Two coupling resistors, each, form a pair which are connected, respectively, to the direct and to the inverting inputs of two operational amplifiers 24, 27. Additionally, the coupling resistors 25, 26 which are connected, respectively, to the inverting and direct inputs of amplifiers 24, 27 are connected by serially connected capacitors 29, 30, the junction between the capacitors being connected to ground, chassis or reference potential. The operational amplifiers are thus connected as comparators with complementary inputs. The outputs of the operational amplifiers 24, 27 are connected to an AND-gate 31, the output of which is connected to terminal 32 to control the relay coil 16. If the power level at terminal 32 is insufficient, then an amplifier, similar to amplifier 21, can be connected between the terminal 32 and coil 16 of the disconnect relay.

Operation of circuit of FIG. 2: The circuit functions as a voltage discriminator. Upon starting, the starter motor 10 draws so much power from the battery 13 that the voltage thereof will drop in undulating manner as the motor 10 draws power therefrom. The capacitors 29, 30, connected respectively to the inverting and direct inputs of the operational amplifiers 24, 27, form, together with the coupling resistors 25, 26 delay networks. Thus, the inverting input of operational amplifier 27 and the direct input of operational amplifier 24 will have the signal at terminal 22 applied directly, while the respective direct and inverting inputs have signals representative thereof connected thereto with some time delay. As a result, the output of the first operational amplifier 24, at any given instant, may have a 1-signal (as indicated by the output sign L), and the output of operational amplifier 27 a 0-signal. Upon change of voltage in opposite direction, the output of the first operational amplifier 24 will change to a 0-signal, and the output of operational amplifier 27 will change to a 1-signal. At all times, however, the outputs of the two operational amplifiers will be complementary. Consequently, AND-gate 31 will be blocked. If no changes in voltage occur, both capacitors 29, 30 will charge. At that time, both outputs of operational amplifiers 24, 27 will have the same signal appear thereon causing the AND-gate 31 to become conductive and provide an output signal which controls the disconnect switch to open the terminals 15 and disconnect motor 10. This is a reliable and safe supervisory circuit which disconnects the starter motor 10 when the engine E has reached overrunning speed.

In a typical embodiment for a 12 V circuit, capacitor 18 was: 4.7 μF the R/C combination 25/29; or 26/30 was: 1 μF; 20 kΩ the integrator 17, in its simplest form, is a storage capacitor having a capacity of 1 kΩ; 33 μF and charging and discharging so long as undulations are present in the power supply, but holding a charge when the undulations cease to thereby control amplifier 21 and hence coil 16.

Various changes and modifications may be made within the scope of the inventive concept.

We claim:

1. For combination with internal combustion engine (E) having a starter motor (10) which is selectively engageable with the engine, an energizing circuit (13) for the motor (10); and manually controllable switch means (11, 12, 14) selectively energizing the motor (10) by selective connection thereof to the energizing circuit, a control circuit (16, 17, 17') including a disconnect switch (15) interrupting energization of the motor (10) when the internal combustion engine (E) has started, comprising, in accordance with the invention, a-c component sensing means (17; 18–21) connected to the energization circuit and sensing the a-c component in the energization circuit comprising undulations or pulsations of at least one of: power supply; voltage; current flow; in the energization circuit due to compression and decompression of gases in the internal combustion engine when the motor is energized but before the engine has started including evaluation circuit means (19–21; 23, 31) evaluating an undulation or pulsation characteristic of said a-c component and providing a disconnect signal to said disconnect switch (15) when said a-c component essentially disappears due to starting of the internal combustion engine.

2. The combination of claim 1, wherein said evaluation circuit means comprises (FIG. 1) means (19, 20, 21) responsive to time variations of energy being supplied to the motor.

3. The combination of claim 2, wherein the means responsive to time variations include an energy change discriminator.

4. The combination of claim 2, wherein the evaluation circuit means includes a filter circuit (19) to filter signals having a frequency high with respect to the a-c component forming the pulsations or undulations of motor current upon cranking of the engine.

5. The combination of claim 1, wherein the evaluation circuit means comprises (FIG. 1) means (19, 20, 21) responsive to the time integral of pulsations sensed by said pulsation sensing means (18) and providing an output signal when the integrator has reached a predetermined integration level.

6. The combination of claim 1, wherein the evaluation circuit means comprises (FIG. 2) means responsive to variations in energy supplied to the motor deviating from an average energy supply and modulating said average energy supply.

7. The combination of claim 6, wherein the evaluation circuit means includes a filter circuit (19) to filter signals having a frequency high with respect to the a-c component forming the pulsations or undulations of motor current upon cranking of the engine.

8. The combination of claim 6, wherein said evaluation circuit means comprises an AND-function circuit (31);

and means (23, 25, 29, 24; 27, 28, 26, 30) supplying signals to said AND-function gate derived from said pulsation sensing means (18) representative of instantaneous and delayed levels of at least one of: power; voltage, current supplied to the motor to hold said AND-function gate in blocked condition unless the instantaneous and delayed values are similar, indicative of steady-state condition, and the absence of pulsations, the AND-function gate controlling interruption of energization to the motor upon occurrence of said steady-state condition.

9. The combination of claim 6, wherein said evaluation circuit means comprises a coupling circuit (23, 28);

a time delay network (25, 26, 29, 30) and a comparator circuit (24, 27) having its inputs connected to the coupling circuit and to the time delay network, respectively, and comparing an instantaneous value in said energization circuit with a delayed value and providing said disconnect signal at its output when the instantaneous and delayed values are similar, indicative of steady-state conditions and absence of an a-c component forming said pulsations or undulations in the energization circuit.

10. The combination of claim 9, wherein said comparator circuit comprises two operational amplifiers (24, 27) having complementary inputs connected to, respectively, said coupling circuit (23, 28) and said time delay network (25, 26, 29, 30) and providing alternating, complementary and opposite outputs when the instantaneous value and the time delayed value applied from said energization circuit are dissimilar, and forming said disconnect signal when said respective instantaneous and delayed inputs are similar.

11. The combination of claim 1, wherein the evaluation circuit means includes a filter circuit (19) to filter signals having a frequency high with respect to the a-c component forming the pulsations or undulations of motor current upon cranking of the engine.

12. The combination of claim 1, wherein the evaluation circuit means comprises a discriminator circuit responsive to change in at least one of: power, voltage, current being supplied to the motor.

13. In a system for starting an internal combustion engine (E) with an electric starter motor (10), the method of determining when the engine has started to provide a starter motor disconnect signal, comprising the steps of separating the a-c or pulsating or undulating component of starter power applied to the motor;

evaluating said a-c component;

and providing said disconnect signal as a function of said evaluation.

14. The method of claim 13, wherein the evaluation step comprises evaluating when the a-c component essentially disappears to provide said disconnect signal when the power supplied to the motor has reached essentially steady-state conditions and there is an absence of pulsations or undulations of motor power.

15. Method according to claim 13, wherein said evaluation step comprises time-integrating the a-c components and said disconnect signal providing step comprises providing said output signal when the thus time-integrated signal is at a predetermined integration level.

* * * * *